United States Patent [19]

Håkansson

[11] 4,202,237

[45] May 13, 1980

[54] DEVICE FOR PRODUCING SOUNDS, WHICH CAN BE COUPLED TO A MUSICAL INSTRUMENT

[75] Inventor: Bjarne C. Håkansson, Täby, Sweden

[73] Assignee: Lindén & Linder AB, Stockholm, Sweden

[21] Appl. No.: 886,615

[22] Filed: Mar. 14, 1978

[30] Foreign Application Priority Data

Apr. 14, 1977 [SE] Sweden ..... 7704290

[51] Int. Cl.[2] ..... G10H 5/06; G10H 5/10

[52] U.S. Cl. ..... 84/1.24; 84/DIG. 11; 84/1.27; 84/1.03

[58] Field of Search ..... 84/1.01, 1.03, 1.04, 84/1.24, 1.25, 1.26, 1.27, DIG. 11; 307/261; 328/14; 364/851, 852

[56] References Cited

U.S. PATENT DOCUMENTS

| | | | |
|---|---|---|---|
| 3,215,860 | 11/1965 | Neumann | 307/261 |
| 3,429,976 | 2/1969 | Tomcik | 84/1.04 |
| 3,539,701 | 11/1970 | Milde | 84/1.28 |
| 3,657,657 | 4/1972 | Jefferson | 307/261 |
| 3,986,426 | 10/1976 | Faulhaber | 84/1.26 |
| 4,038,895 | 8/1977 | Clement | 84/1.27 |
| 4,061,909 | 12/1977 | Bryant | 328/14 |

*Primary Examiner*—J. V. Truhe
*Assistant Examiner*—William L. Feeney
*Attorney, Agent, or Firm*—Finnegan, Henderson, Farabow, Garrett & Dunner

[57] ABSTRACT

The device of the invention extracts a fundamental frequency from signals coming from a played musical instrument. From this is synthesized a waveform with the same fundamental frequency which can be given an arbitrary form, so that an audical impression of e.g. a violin, a trumpet or a guitar can be given to sound produced by the waveform. The waveform is produced by making a pulse train with frequency n times the fumdamental frequency, leading the pulse train to a counter activating cyclically and sequentially n different outputs. The outputs are summed with different and adjustable weights, and the waveform is determined by adjusting the n weights. The number n can be any number. An embodiment is shown with n=16.

4 Claims, 3 Drawing Figures

DEVICE FOR PRODUCING SOUNDS, WHICH CAN BE COUPLED TO A MUSICAL INSTRUMENT

The present invention relates to a device which can be coupled to a musical instrument and which analyzes the musical signal produced with regard to its "melody-determining" frequency and produces an adjustable, "synthesized" tone signal with the same fundamental frequency. By varying the setting of the tone signal (or, in other words, its overtone composition) a variety of effects can be achieved, both new sound effects and imitations of existing musical instruments.

Since the days of Helmholtz it has been known that different musical instruments have different characteristic wave shapes, and this can be demonstrated by oscillographic methods. Analysis of such wave shapes has produced the term "overtones", which has to do with harmonic analysis (Fourier analysis). Later on, instruments were made, based on this harmonic analysis, in which a fundamental is produced and a suitable set of overtones thereto. The overtone spectrum then determines the subjective sound impression.

A variety of electrical musical instruments have been constructed according to these principles, such as electromechanical organs, where the tone stems from the sensing of rotating cams for example. Thereafter, there were a number of intermediate forms extending up to today's electronic music.

It is a purpose of the present invention to achieve a device for producing sounds which can be connected to an ordinary musical instrument. The intention is that the player will be able to achieve special tonal effects adapted to the music being played and providing the player with possibilities for artistic expression.

These and other purposes, which will be evident from the rest of the description of an embodiment, are fulfilled according to the invention by means of a device for producing sounds which has the characteristics disclosed in the characterizing clause of claim 1.

By way of introduction and in order to explain but not limit the invention, the general functioning of the invention can be summarized as follows.

A representative electric signal is taken from an instrument being played. If it is an electric guitar, the output signal is taken, and in certain cases a microphone signal can be taken. Even the human voice can be used as the instrument.

From this instrument signal the "fundamental" is extracted, i.e. the lowest frequency to be found in the same (disregarding beat frequencies and the like). When using a polyphonic instrument, as a rule, the fundamental for the highest played note is selected, which is usually the note carrying the melody. It is this extracted fundamental which is the basis for the wave to be created in the device. This is done by generating a wave with a frequency corresponding to the extracted fundamental, and the character of the fundamental can then be varied within extremely wide limits by varying the "shape" of the wave.

In order to be able to create a wave of virtually any shape desired, and which has a frequency determined by the extracted fundamental, a number of parallel outputs are used from which pulses are sent sequentially. Said pulses from each of the outputs have the same frequency as the fundamental, and the pulse lengths are equal to the period for the fundamental divided by the number of outputs. For each output there is a current divider or the like which can be adjusted individually or by groups, and the signals from the current dividers are then put together to form the final wave shape.

In order to achieve a suitable timbre, the wave produced can also be mixed with the original instrument signal. Since many instrument effects depend on so-called "transients", it is also conceivable to control the mixing formula between the synthetic wave form and the signal from the instrument and even make the mixing dependent on time. It is also possible to arrange several sets of current dividers to produce synthetic waves, so that shifting between them will produce a change which is quite striking. If this wave-shape change is then made time-dependent, virtually any musical effect whatsoever can be achieved.

A better understanding of the invention will be provided now by an example described in connection with the drawings.

The example shown is largely made up of standardized integrated circuits, and the manufacturer's data sheets will provide the skilled art worker with much information on circuit structures, current supply and the like. Therefore, in the following functional description such easily available information will not be supplied.

Figure 1:
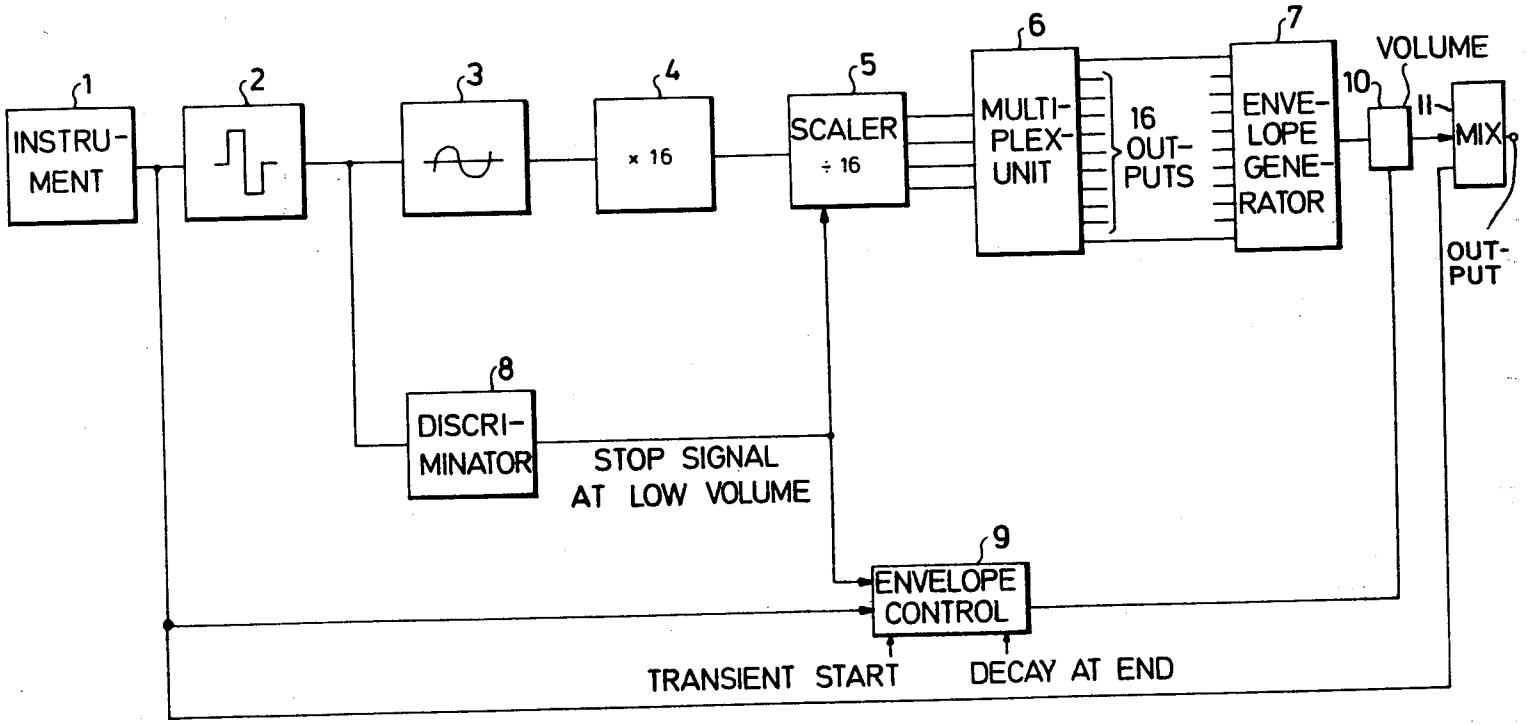
FIG. 1 is a flow chart of a device for producing sounds according to the invention.

FIG. 1 shows a flow chart of an embodiment of the invention. Block 1 represents an instrument, for example a solo guitar. If several strings are struck at the same time, equipment is required, as was mentioned in the introduction, to see to it that only the signal of the representative string is taken. The skilled art worker will see that there are many ways of doing this. For example, signals from each string can be sensed individually and the highest pitched one will be coupled through.

In block 2 a square wave is produced by the signal in a known manner by amplification and amplitude limitation. The square wave obtained is then transformed in block 3 to a sine wave. A suitable method of doing this is to allow it to pass two integrating amplifiers coupled in series. (Many other methods are known.) The more-or-less pure sine-shaped signal thus obtained is then multiplied so as to obtain a frequency which is N times as high. In the example N is equal to 16, and the multiplied frequency is obtained in four frequency-doubling steps.

Thus there is now a sine wave signal, which has a frequency which is 16 times as high as that of the fundamental provided by the instrument. If, for example, one assumes that the instrument produces an "A" (440 Hz), we see that the frequency coming from block 4 is 7.04 kHz.

This signal is led to block 5 which consists of a binary four step scaler. Each of the four flip-flop circuits therein has an output, and these outputs deliver successively in parallel form the binary numbers 0 to 15 during each period of the analyzed fundamental.

In the multiplex unit 6 these binary signals are decoded through four parallel inputs to output signals from 16 outputs. These output signals are such that each time the number represented by the signals through the four inputs assumes a certain value, one of the 16 outputs which has been assigned this value gives off a 1 signal, while the rest of the outputs give off 0 signals. This means that during one period for the fundamental, the various outputs will be gone through in sequence, and once again during the next period, and so on. According to the above example, each output will give off a pulse 440 times per second.

These 16 outputs from the multiplex unit are now coupled to an envelope generator 7. This generator comprises an adjustable voltage divider for each of the 16 inputs. One can see that if all of the voltage dividers are set the same, then a constant signal will be produced which is not a wave at all. If instead they are set according to the amplitude distribution over the period for example of a sine wave, an almost pure sine wave is produced. How pure these sine waves can be is discussed in the description of U.S. Pat. No. 3,215,860, which, however, shows a division of the period into 18 equal parts. Said invention is intended to produce sine waves which are as pure as possible.

In the present invention the different voltage dividers are set in accordance with the wave shape desired. This can be done either by experimenting or by using known wave shape curves for specific instruments. These are published in the literature on physical acoustics from Helmholtz' pioneering work up to the present day.

It is undesirable to have an output signal from the device if there is no tone, only background noise. Thus it is suitable to arrange a discriminator circuit 8 which determines whether a signal from the instrument or from the block 2 exceeds a predetermined, set minimum level.

If the signal from the instrument lies below a certain level, the action of the apparatus is halted. A suitable way of doing this is to allow a logic signal from the discriminator control the functioning of the scaler 5, so that it is simply shut off when there is no signal.

As has already been mentioned, many integrated circuits are included in the flow chart in FIG. 1. It should not be necessary to show complete circuit diagrams of the entire system, since this would make the present description much too long. Therefore, only a general and somewhat detailed functional description will be given here.

It is suitable before the square-wave generator in block 2 to limit the treble range, with a low-pass filter for example. The square wave produced by over-modulation and clipping is then allowed to go via two integration amplifiers, coupled in series, which can be based on operational amplifiers of type 741. Although this has not been shown in FIG. 1, it can be suitable to allow the sine wave thus generated to pass a circuit which normalizes the signal amplitude to a specific amplitude. An example of such a circuit is shown in Electronics, Aug. 16, 1973, p. 100.

A suitable method of frequency multiplication is to use a Motorola MC 1496 circuit (Balanced Modulator-Demodulator). If the same sine signal is coupled into both of its inputs, an output signal is produced which has twice the frequency. This can be explaned by the fact that in multiplying two identical sine signals with one another the following equation applies:

$$\sin^2(wt) = \tfrac{1}{2}(1 - \cos(2wt)),$$

and regarding only the alternating current components, one can see that there actually is a doubling of the frequency. If this is done four times in a row, the desired result is obtained. The frequency multiplication can also be done by allowing the square wave to go directly to a phase-locked circuit adapted for this purpose (see for example RCA's handbook on digital CMOS circuits).

A suitable scaler is sold under the type designation 7493 (Texas Instruments), and a suitable multiplexing circuit can be obtained from the same manufacturer under number 74154.

There are 16 parallel outputs from the multiplex unit, and it is by manipulating these that the inventive sound effects are obtained. It is conceivable to have each of these 16 signals attenuated in an individual resistance net. By adjusting these nets it is possible to obtain any desired wave form within the limitations set by there being only 16 degrees of freedom.

Figure 2:
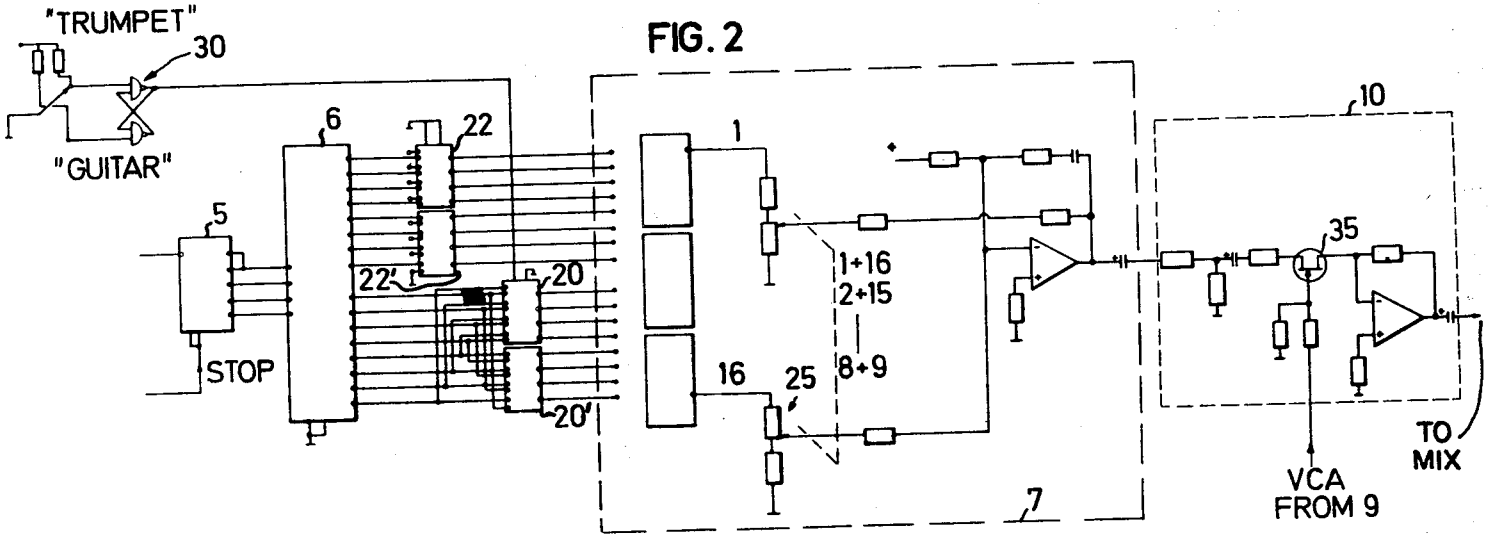
FIG. 2 shows in detail a multiplex unit and envelope generator as well as a volume control for the inventive sound effect.

Instead of this general circuit scheme, according to an embodiment which is now preferred, a coupling is used, in which the settings are pairwise dependent. FIG. 2 shows how output channels 1 and 16 are coupled to individual potentiometers 25, which are coupled together for common adjustment in such a way that when one of them is set for minimum the other is set for maximum, and vice-versa. Channels 2+15, 3+14, . . . 8+9 are arranged in pairs in the same manner. Such a configuration can preferably be set for "odd" overtones.

FIG. 2 shows that the multiplex unit's outputs are coupled to switching circuits. If the circuits 20 and 20' receive a logic address signal, there will be a switching so that output 15 from the multiplex unit 21 will be coupled to output 9 etc., so that the sequence for the signals 1–16 to the potentiometers will be 1,2, . . . , 7,8,16,15,14, . . . 10,9. In order to avoid an erroneous and asymmetrical delay effect, corresponding circuits must also be arranged on outputs 0–7 from the multiplex unit, which are however always coupled for the same pulse paths.

This switching which, as can be seen from the figure, is done via a manually adjustable switching circuit 30, changes the overtones between "odd" and "even", so that the character of the tone is changed. The labels of the settings ("trumpet" and "guitar") are in many cases quite descriptive of the subjective impression.

It can also be seen from FIG. 2 that there is a "volume control" for the outcoming envelope result. This circuit has its core in a field effect transistor 35, and the volume is controlled by the current on its control electrode.

Figure 3:
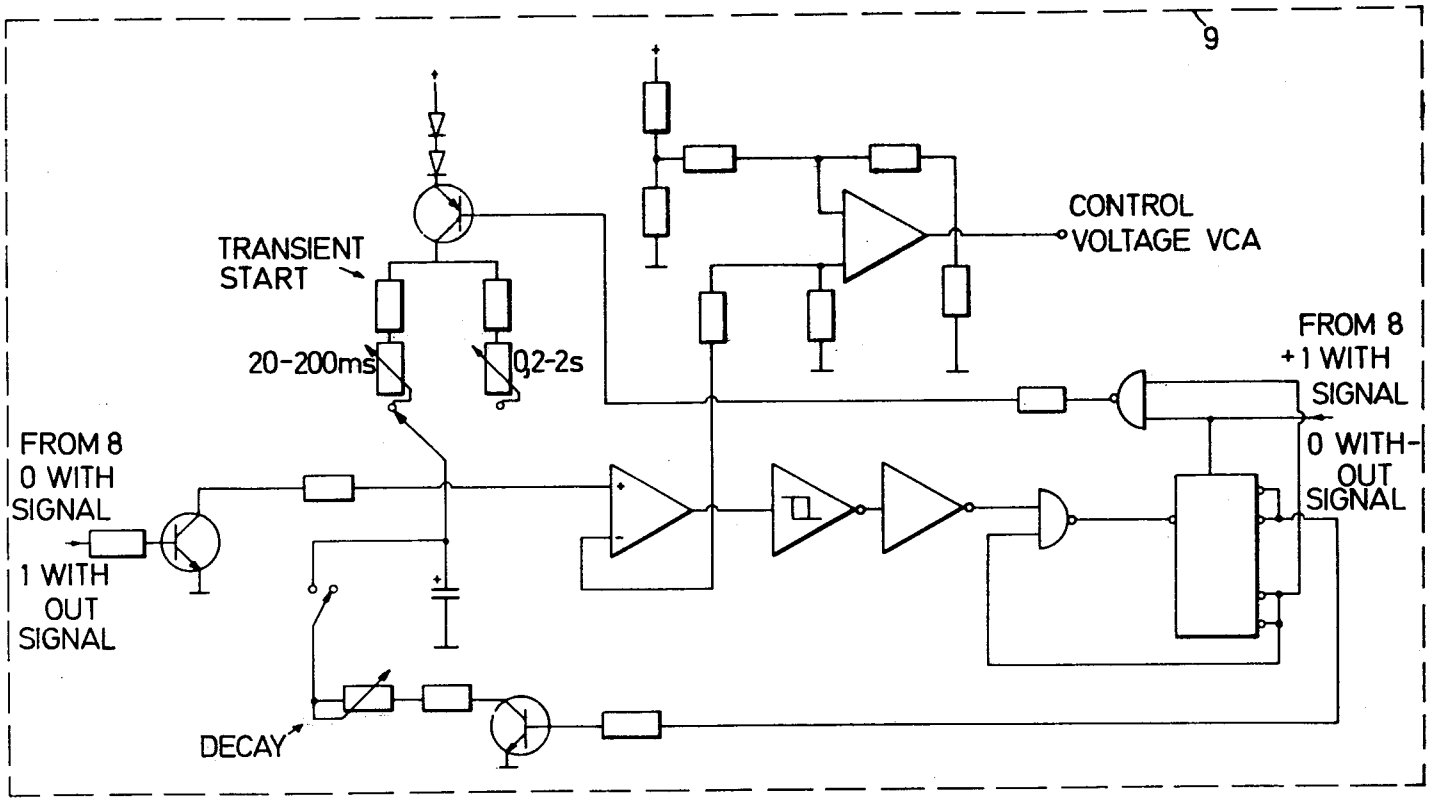
FIG. 3 shows a circuit for volume control, in which the transient build-up of a synthetic tone or sound can be influenced.

Returning now to FIG. 1, one can see that the volume control is controlled by a circuit 9, labelled "envelope control". One design of the circuit 9 is shown in FIG. 3. The input signals, which are logic signals, are derived from the discriminator 8 in FIG. 1. The control voltage VCA, which governs the volume control, starts a logarithmic ramp signal whose time constant is continuously adjustable within two different intervals by means of logarithmic potentiometers, either 20—200 ms or 0.2—2 s. This setting is of great importance for the build-up transients of the tones, since the field effect transistor 35 in block 10 (see FIG. 2) produces a modulation effect. This provides an additional quite extensive possibility for changing the subjective impression of the sound. The decay sequence can also be adjustable, for example according to FIG. 3.

Quite a number of different variations are possible within the present inventive idea. For example, the envelope circuit can be made so that it can be quickly varied. One can also have a selection of such settings which can be switched in, so that the musician can switch quickly between different effects, such as from "trumpet tone" to "string tone" or from overtone patterns in "fifths" to "octaves" (i.e. for wind instruments of conical or cylindrical shape respectively.)

The device described here has almost unlimited sound possibilities. In the embodiment described it is possible to set a wave shape at 16 equidistant points, but it is obvious that one can go even further, if even more exact settings and even higher overtone are desired. Simple analysis shows that it is possible via the 16 time channels according to the embodiment shown to independently set up all harmonic overtones up to the eighth, both with regard to size and phase. Although in certain cases even higher overtones have been considered to be of importance for the subjective tonal impression, very great freedom in setting the tones is provided in any case. And considering the fact that the original tone coming from the instrument can also be added to the synthetic tone, one can see that an instrument equipped with the device according to the invention provides the musician with very great freedom.

The output signal from the device for producing sounds can either be coupled directly or via amplifiers to a loud-speaker system, or even be additionally processed by various means, registered etc., before a musical result is finally delivered to a loud-speaker.

What I claim is:

1. Device for producing sounds which can be coupled to a musical instrument characterized by means disposed to extract a fundamental frequency from a signal coming from said musical instrument; means for multiplying said fundamental frequency to obtain a frequency which is n times as high as the fundamental frequency, n being an integer; counting means with n outputs, coupled to the frequency n times as high as the fundamental in order to give off output signals at this higher frequency, sequentially and cyclically from the n outputs, each output giving off an output signal at the same frequency as said fundamental frequency extracted from the instrument signal, said n outputs each being coupled to an individual adjustable attenuation circuit, the output signals of said attenuation circuit being coupled together to create a composite signal.

2. Device for producing sounds according to claim 1, characterized in that said device includes a discriminator disposed to sense whether a tone signal exceeding a certain level is coming from the instrument, and in the absence of such a signal, to produce an output signal which stops said counting means.

3. Device for producing sounds according to claim 2, characterized in that it comprises a control circuit disposed upon receiving an output signal from the discriminator to give off a ramp signal (VCA) increasing to a maximum value, said ramp signal being coupled to a volume circuit functioning as a mixing circuit, said ramp signal mixed with said composite signal from the attenuation circuits giving a build-up transient form to the signal coming from the volume control circuit.

4. Device for producing sounds according to one of the preceding claims, characterized in that the instrument signal and the composite signal are coupled to a mixing circuit, to produce an output signal.

* * * * *